US010636332B2

(12) United States Patent
Pangrace

(10) Patent No.: US 10,636,332 B2
(45) Date of Patent: Apr. 28, 2020

(54) DIGITAL COLOR CHIP METHOD

(71) Applicant: John Fred Pangrace, Rocky River, OH (US)

(72) Inventor: John Fred Pangrace, Rocky River, OH (US)

( * ) Notice: Subject to any disclaimer, the term of this patent is extended or adjusted under 35 U.S.C. 154(b) by 0 days.

(21) Appl. No.: 16/022,416

(22) Filed: Jun. 28, 2018

(65) Prior Publication Data

US 2019/0005854 A1 Jan. 3, 2019

Related U.S. Application Data

(60) Provisional application No. 62/525,893, filed on Jun. 28, 2017.

(51) Int. Cl.

| | |
|---|---|
| ***G03G 5/00*** | (2006.01) |
| ***G09F 5/04*** | (2006.01) |
| ***B41M 3/00*** | (2006.01) |
| ***G03G 5/10*** | (2006.01) |
| ***G03G 5/12*** | (2006.01) |
| ***G03G 5/14*** | (2006.01) |

(52) U.S. Cl.

CPC ..... *G09F 5/04* (2013.01); *B41M 3/005* (2013.01); *G03G 5/10* (2013.01); *G03G 5/12* (2013.01); *G03G 5/14* (2013.01); *G09F 5/042* (2013.01)

(58) Field of Classification Search

CPC ..... G03G 5/10; G03G 5/12; G03G 5/14
USPC ..... 430/45.1, 97
See application file for complete search history.

(56) References Cited

U.S. PATENT DOCUMENTS

| | | | | |
|---|---|---|---|---|
| 6,121,382 | A * | 9/2000 | Chang | B41M 5/52 524/31 |
| 2004/0045931 | A1* | 3/2004 | Hill | B41M 3/008 216/54 |
| 2010/0015421 | A1* | 1/2010 | Tyagi | G03G 9/0821 428/207 |
| 2011/0211856 | A1* | 9/2011 | Bettiol | G03G 15/0896 399/82 |
| 2013/0157826 | A1* | 6/2013 | Preckel | B41M 3/008 493/53 |
| 2014/0370252 | A1* | 12/2014 | Regnier | B32B 27/36 428/201 |
| 2015/0268589 | A1* | 9/2015 | Nedelin | G03G 15/101 101/216 |

* cited by examiner

*Primary Examiner* — Mark A Chapman
(74) *Attorney, Agent, or Firm* — Wentsler LLC

(57) ABSTRACT

A color display fan deck or a color card has a substrate having a first surface and a second surface. The color display fan deck or color card has a base layer that is applied to one of the first surface or the second surface of the substrate. The base layer has an adhesion promoting material. A process color is applied to the base layer by a digital printing process. A method of manufacturing a color display device is also provided.

11 Claims, 4 Drawing Sheets

DIGITAL COLOR CHIP METHOD

CROSS-REFERENCE TO RELATED APPLICATIONS

This application claims priority to and the benefit of U.S. Provisional Patent Application No. 62/525,893 that was filed on Jun. 28, 2017 and titled "DIGITAL COLOR CHIP METHOD," the entire disclosure of which is herein incorporated by reference.

BACKGROUND

A fan deck comprises one or more easy to view strips arranged by color family. A color card comprises one or more (e.g., two to eight pages) strips displaying a palette of color samples along with photographs of rooms or structures utilizing the color palette. The fan deck may display various shading and intensities of colors and/or hues. In the past, a lithographic process has been used for the representation of color paint chips for a color card. However, the lithographic process has a number of drawbacks. For example, the number of paint colors available to a consumer may far exceed the color gamut that is achievable from lithographic printing. That is, the lithographic process may not be able to reproduce all of the colors that are available to consumers. In addition, the lithographic process experiences problems with consistency during a print run. For example, paper substrates used for the lithographic printing process may impact the results. In addition, in most consumer relevant situations, color samples may need to be chipped and/or deposited onto the printed samples, which is a costly and time consuming process.

SUMMARY

According to an aspect, a color display fan deck comprises a substrate having a first surface and a second surface. The color display fan deck comprises a base layer that is configured to be applied to one of the first surface or the second surface of the substrate. The base layer comprises an adhesion promoting material. The color display fan deck comprises a process color configured to be applied to the base layer by a digital printing process.

According to another aspect, a method of manufacturing a color display device is provided. The method comprises providing a substrate. The method comprises applying a base layer to the substrate, the base layer comprising an adhesion promoting material. The method further comprises applying a process color to the base layer by a digital printing process.

According to another aspect, a method of manufacturing a color display device is provided. The method comprises providing a substrate comprising a paper material. The substrate has a first surface and a second surface. The method comprises applying a base layer to at least one of the first surface or the second surface of the substrate, the base layer comprising an adhesion promoting material. The method comprises applying a process color to the base layer by a digital printing process including one of a xerography printing process, an inkjet printing process, or a liquid Electroink process.

DESCRIPTION

Figure 1:
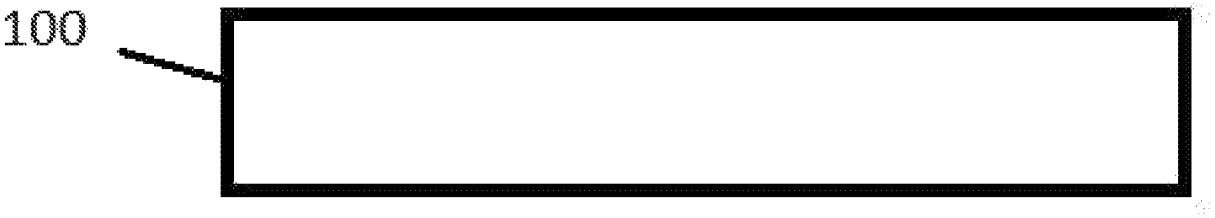
FIG. 1 illustrates a substrate of the color display device.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are illustrated in block diagram form in order to facilitate describing the claimed subject matter.

The present disclosure relates to the replacement of the chipping process with new print technologies. The present application comprises a number of steps. The present disclosure allows for the manufacture of a color display device (e.g., 106 at FIG. 3), such as a color display fan deck, a color card, a color swatch, or the like. In particular, as a result of the present disclosure, natural variances in a substrate may be reduced and/or minimized, thus producing a color display device having more consistent colors and/or higher brightness.

Referring to FIG. 1, initially, a substrate 100 may be obtained and provided. In an example, the substrate 100 may comprise a paper material, though any number of materials and/or combinations of materials may be used. For example, the substrate 100 may comprise a board (e.g., paperboard, cardboard, foamboard) or the like. In an example, the substrate 100 may be substantially flat and/or planar, though, in other examples, the substrate 100 may comprise other non-planar shapes. The substrate 100 may be smooth or rough, for example.

In an example, the substrate 100 may comprise a first surface and a second surface. The first surface may define a top surface of the substrate 100 while the second surface may define a bottom surface of the substrate 100. It will be appreciated that the substrate 100 illustrated in FIG. 1 is merely exemplary, and, in operation, may have a variety of different sizes and shapes. For example, the substrate 100 may be narrower, such that the first surface and the second surface may be in closer proximity to each other than as illustrated.

Figure 2:
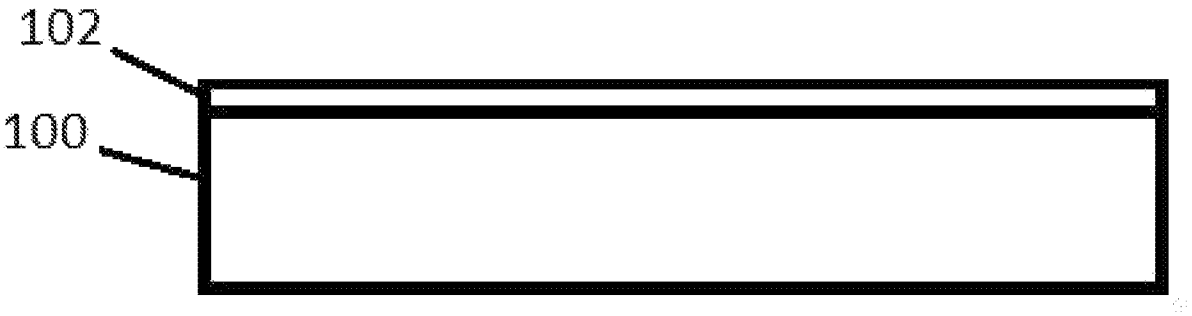
FIG. 2 illustrates the substrate and a base layer of the color display device.

Referring to FIG. 2, an initial base layer 102 may then be applied to the substrate 100. The base layer 102 (e.g., a primer layer) can be applied in any number of ways to the substrate 100. For example, the base layer 102 can be applied by a xerography printing process, ink jet printing, screen printing, etc. In an example, the base layer 102 may be applied by an in-line process. The base layer 102 may be applied to one or both sides of the substrate 100. The base layer 102 may comprise any number of materials that can provide for improved adhesion of an additional material (e.g., process color 104) to the substrate 100.

In the illustrated example, the base layer 102 has been applied to the first surface (e.g., the top surface) of the substrate 100. However, such a location is not intended to be limiting. Rather, in an example, the base layer 102 may be applied to the second surface (e.g., the bottom surface)

instead of the first surface. In yet another example, the base layer 102 may be applied to the first surface and to the second surface.

A purpose and/or benefit of applying the base layer 102 to the substrate 100 is that the base layer 102 can function to reduce and/or nullify some or all of the effects of the substrate 100. That is, inconsistencies may inherently be present from one substrate 100 to another. These inconsistencies may include, for example, differences in: substrate color (e.g., white paper with varying brightness levels, grey paper, black paper), substrate transparency (e.g., some substrates may be more translucent than others), etc. For example, one substrate 100 may have a first color or a first transparency while a second substrate 100 may have a second color or a second transparency. In such an example, the first color may be different than the second color, and/or the first transparency may be different than the second transparency.

The base layer 102 can function similarly to a primer so as to minimize and/or nullify these differing effects of the substrate 100. In this way, the substrate 100 may be chosen with less regard to inconsistencies between varying substrates due to the base layer 102 minimizing and/or nullifying these inconsistencies.

As such, the base layer 102 can provide for a more consistent layer on the substrate 100. In an example, the base layer 102 may also offer a superior initial whiteness/brightness base which can dramatically enhance the reproduction color gamut. In an example, the base layer 102 can be opaque and have a significantly higher brightness level than conventional printing substrates and will be the consistent standard from job to job. The base layer 102 may comprise a material that increases brightness of the base layer 102, such as titanium dioxide, for example.

Figure 3:
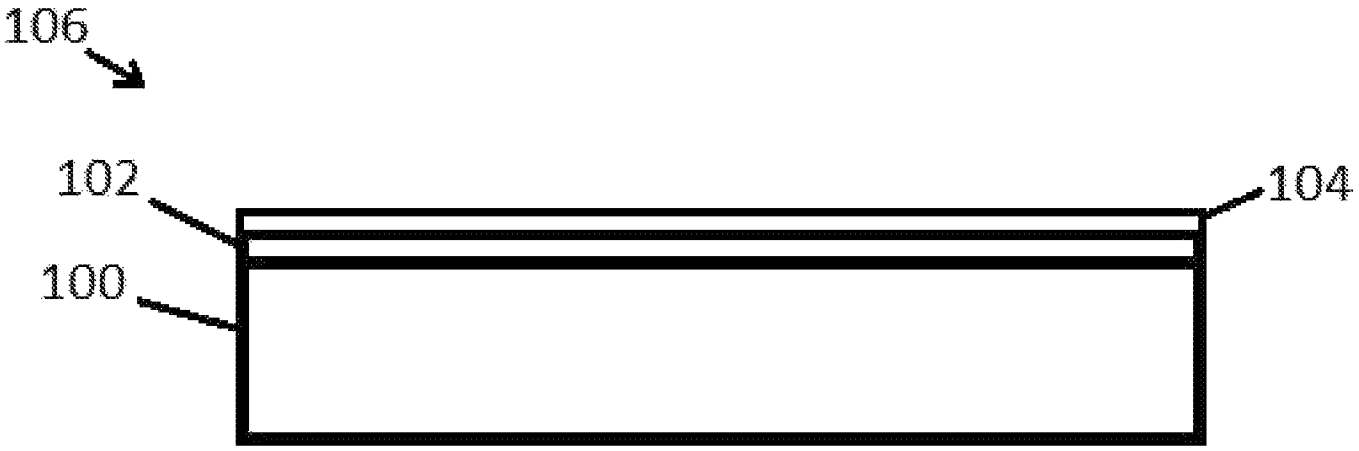
FIG. 3 illustrates the substrate, the base layer, and a process color of the color display device.

Referring to FIG. 3, once the base layer 102 has been applied to the substrate 100, a process color 104 and/or a combination of process colors may be applied to the base layer 102. In an example, the process color 104 and/or combination of process colors may be applied by a digital printing process including, but not limited to xerography, inkjet and liquid Electroink technology.

When the process color 104 is applied to the base layer 102 by an inkjet process, one or more inkjet printheads may comprise nozzles that dispense drops of colored ink to the base layer 102. In an example, a plurality of inkjet printheads may be provided, with printheads capable of dispensing a cyan color (e.g., C), a magenta color (e.g., M), a yellow color (e.g., Y), and a black color (e.g., K). When the process color 104 is applied to the base layer 102 by a liquid Electroink technology, a liquid solution having electrically charged ink particles may be applied to the base layer 102. A location of the ink particles may be electrically controlled.

In an example, the process color 104 may comprise a single process color applied over the base layer 102. In another example, different process colors 104 may be applied to the base layer 102. For example, in a first region 110, a first process color may be applied to the base layer 102, while in a second region 110, a second process color may be applied to the base layer 102. In such an example, the first process color may be different than the second process color. In this way, the process color 104 may comprise a plurality of process colors applies to the base layer 102 on one side (e.g., first surface or second surface) of the substrate 100.

By providing for digital application onto the base layer 102, the present application allows for a wider range of colors to be reproduced. In an example, the traditional CYMK process color model can be modified. In particular, additional colors may be added to the color reproduction system to expand the process gamut in one or more areas. Additional colors may include, for example, (e.g., beyond cyan color (e.g., C), a magenta color (e.g., M), a yellow color (e.g., Y), and a black color (e.g., K)) orange, green, and violet. In this way, toners may be provided to apply one or more of the following colors: cyan, magenta, yellow, black, orange, green, and violet, thus increasing the number of different colors that can be reproduced with the technology of the present application.

In an example, current digital CMYK methods have a greater color gamut than conventional lithographic printing, especially when compared to the industry standard G7 specification. In addition, additional process colors can allow for significant expansion of the reproducible color gamut (e.g., orange, green and violet have been recently incorporated with the traditional CYMK color model to improve the reproduction of certain colors). This color system technology can be improved upon with the present application to find the best combination.

Figure 4:
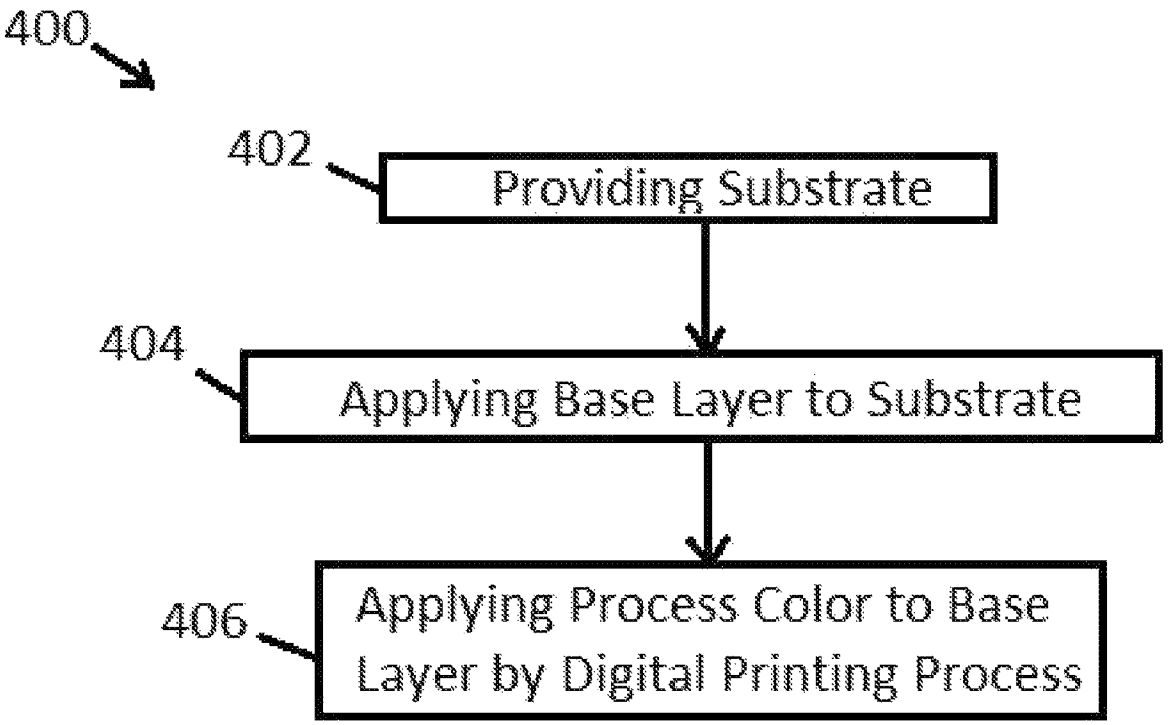
FIG. 4 illustrates a method of manufacturing a color display device.

Referring to FIG. 4, an example method 400 of manufacturing the color display device (e.g., 106 in FIG. 3) is illustrated. In an example, at 402, the method 400 comprises providing a substrate 100. The substrate 100 may comprise a paper material, with the substrate 100 having a first surface and a second surface. In an example, at 404, the method 400 comprises applying the base layer 102 to the substrate 100. The base layer 102 may comprise an adhesion promoting material. For example, an adhesion promoting material may be a material that functions to allow for the base layer 102 to be adhered to the substrate 100, and the process color 104 to be adhered to the base layer 102. The base layer 102 may also be applied to at least one of the first surface or the second surface of the substrate 100. In an example, at 406, the method 400 comprises applying a process color 104 to the base layer 102 by a digital printing process. The digital printing process may include one of a xerography printing process, an inkjet printing process, or a liquid Electroink process.

The end result of the aforementioned process provides a number of benefits. For example, it may be possible to reproduce all fan-deck colors to a dE 0.5 level. In an example, the percentage of fan-deck colors that are reproducible by conventional CMYK values within the G7 specification is relatively high (e.g., greater than 85%). However, maintaining consistency in print run is important. It is extremely difficult to achieve the required level of accuracy with conventional lithography. Indeed, the colors that are difficult to reproduce may be saturated colors and lighter, cleaner colors. Saturated colors can be affected by the density (darkness) of the process colors, and the bright cleaner colors can be addressed by the base layer 102 (e.g., primer). An accurate reproduction rate of over 97% is possible with the aforementioned process. In addition, the colors that are used in marketing materials will most likely fall within these parameters.

Additional benefits of this process include, but are not limited to, the reduction of production costs, reduction and/or elimination of waste, shortening of production cycles, having the ability to produce smaller customized production runs, being able to integrate imagery with a sample to represent faux effects and a digitally printed topcoat to simulated the sheen of the reproduced paint chip.

The term "exemplary" may be used herein to mean serving as an example, instance, illustration, etc., and not necessarily as advantageous. As used in this application, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B and/or both A and B. Furthermore, to the extent that "includes", "having", "has", "with", or variants thereof are used, such terms are intended to be inclusive in a manner similar to the term "comprising".

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first item and a second item may generally correspond to item A and item B or two different or two items or the same item.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular, regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A method of manufacturing a color display device, the method comprising:

providing a substrate comprising a paper material;

reducing inconsistencies in the substrate, the inconsistencies comprising a whiteness and a brightness of the substrate, by applying a base layer comprising an opaque material that is titanium dioxide, directly to a surface of the substrate to increase the brightness as compared to the substrate, the base layer comprising an adhesion promoting material, the base layer applied directly to the surface of the substrate by a xerography printing process; and applying a process color directly to the base layer by a digital printing process, wherein the application of the process color to the base layer is by a different printing process than the application of the base layer to the substrate.

2. The method of claim 1, wherein the digital printing process comprises applying the process colors of cyan, magenta, yellow, and black.

3. The method of claim 2, wherein the digital printing process comprises applying the process colors of orange, green, and violet.

4. The method of claim 1, wherein the process color is applied to the base layer by a xerography printing process.

5. The method of claim 1, wherein the process color is applied to the base layer by an inkjet printing process.

6. The method of claim 1, wherein the process color is applied to the base layer by a liquid Electroink process.

7. The method of claim 1, wherein the brightness of the base layer is higher than the brightness of the substrate.

8. The method of claim 1, wherein the base layer comprises titanium dioxide.

9. A method of manufacturing a color display device, the method comprising:

providing a substrate comprising a paper material, the substrate having a first surface and a second surface;

applying a base layer to at least one of the first surface or the second surface of the substrate, the base layer comprising an adhesion promoting material and a brightness that is higher than a brightness of the substrate; and applying a process color to the base layer by a digital printing process including one of:

a xerography printing process;

an inkjet printing process; or a liquid Electroink process, wherein the application of the process color to the base layer is by a different printing process than the application of the base layer to the substrate.

10. The method of claim 9, wherein the base layer is applied to the first surface or the second surface of the substrate by a xerography printing process.

11. A method of manufacturing a color display device, the method comprising:

providing a substrate comprising a paper material;

reducing inconsistencies in the substrate, the inconsistencies comprising a whiteness and a brightness of the substrate, by applying a base layer to a surface of the substrate to increase the brightness as compared to the substrate, the base layer comprising an adhesion promoting material, wherein the base layer comprises titanium dioxide, the base layer applied directly to the surface of the substrate by a xerography printing process; and applying a process color directly to the base layer by a digital printing process.

* * * * *